US011608092B2

(12) United States Patent
Huck et al.

(10) Patent No.: US 11,608,092 B2
(45) Date of Patent: Mar. 21, 2023

(54) HOURGLASS AUTORACK CAR INTERIOR

(71) Applicant: Trinity Rail Group, LLC, Dallas, TX (US)

(72) Inventors: Kenneth W. Huck, Fairview, TX (US); Kyle R. Coston, Forney, TX (US)

(73) Assignee: TRINITY RAIL GROUP, LLC, Dallas, TX (US)

( * ) Notice: Subject to any disclaimer, the term of this patent is extended or adjusted under 35 U.S.C. 154(b) by 407 days.

(21) Appl. No.: 16/847,049

(22) Filed: Apr. 13, 2020

(65) Prior Publication Data

US 2021/0316768 A1 Oct. 14, 2021

(51) Int. Cl.
*B61D 17/08* (2006.01)
*B61D 3/18* (2006.01)

(52) U.S. Cl.
CPC ..... *B61D 3/187* (2013.01); *B61D 17/08* (2013.01)

(58) Field of Classification Search
CPC ..... B61D 3/187; B61D 3/181; B61D 17/12; B61D 3/18; B61D 17/08; B61D 3/02; B61D 1/06; B61D 3/185
See application file for complete search history.

(56) References Cited

U.S. PATENT DOCUMENTS

| | | | | |
|---|---|---|---|---|
| 3,474,740 | A * | 10/1969 | Varnes | B61D 5/06 105/360 |
| 7,780,021 | B2 * | 8/2010 | Forbes | B61G 9/24 213/50 |
| 9,346,472 | B2 * | 5/2016 | Black | B61F 1/14 |
| 2011/0005425 | A1 * | 1/2011 | Creighton | B61D 17/08 105/413 |
| 2014/0130707 | A1 * | 5/2014 | Batchelor | B61D 23/00 105/404 |
| 2017/0334462 | A1 * | 11/2017 | Richmond | B61D 3/18 |

* cited by examiner

*Primary Examiner* — Mark T Le
(74) *Attorney, Agent, or Firm* — Baker Botts L.L.P.

(57) ABSTRACT

A railcar comprises a first end, a second end, and a first longitudinal side and a second longitudinal side disposed between the first end and the second end. The first longitudinal side comprises a center panel and an intermediate panel. The center panel is disposed between a center of the railcar and the intermediate panel. The intermediate panel is disposed between the center panel and the first end or the second end. A width of the railcar at the intermediate panel is greater than a width of the railcar at the center panel. The center panel and the intermediate panel comprise generally straight panels coupled together at an angle. The first longitudinal side may further comprise an end panel disposed between the intermediate panel and the first end or the second end.

17 Claims, 8 Drawing Sheets

HOURGLASS AUTORACK CAR INTERIOR

TECHNICAL FIELD OF THE INVENTION

This disclosure generally relates to railcars, and more particularly to an hourglass shaped autorack railcar.

BACKGROUND

An autorack railcar (also referred to as an auto carrier or car transporter) is a railcar for transporting automobiles and light trucks. For example, an autorack railcar may transport vehicles from a manufacturing facility to a distributorship, or transport vehicles for passengers of a passenger train service.

An autorack railcar generally includes two or three decks for transporting vehicles. Some autorack railcars are convertible between two and three decks. The cars are typically fully enclosed with continuous side panels, end doors, and roofs to protect the vehicles from severe weather, theft/vandalism, or other in-transit damage.

To load an autorack railcar, a skilled driver drives the vehicle up a ramp and onto one of the decks. The driver or another crew member then secures the vehicle to the deck with tie down straps, chains, etc. The process is reversed to unload the autorack railcar.

Conventional autorack railcars typically have limited interior width for personnel to maneuver between the side panels of the railcar and vehicles loaded in the railcar. This problem is more noticeable with wide vehicles, such as pickup trucks with sets of dual rear wheels, or vehicles without folding mirrors.

A conventional autorack railcar may be a constant width (e.g., 9' 11") for the length of the railcar. Railcar width is constrained by American Association of Railroads (AAR) regulations in Standard S-2030 Plate D, S-2047 Plate J, and S-2048 Plate K. Plates J and K describe the overall equipment diagram for railcars up to 19' 0" and 20' 3" tall, respectively.

SUMMARY OF THE INVENTION

The constant width of a conventional autorack railcar provides limited interior width for personnel to maneuver between the side panels of the railcar and the vehicles loaded in the railcar. The embodiments described herein include a variable width, hourglass-shaped autorack railcar.

According to some embodiments, an autorack railcar comprises a first end and a second end, and a first longitudinal side and a second longitudinal side disposed between the first end and the second end. Each of the first longitudinal side the second longitudinal side comprising a plurality of side posts. The autorack railcar further comprises a rack for transporting vehicles generally enclosed by the first end, the second end, the first longitudinal aide, and the second longitudinal side. A first width of the autorack railcar between the first longitudinal side and the second longitudinal side proximate a center of the autorack railcar comprises a first width value. A second width of the autorack railcar between the first longitudinal side and the second longitudinal side between the center of the autorack railcar and either the first end or the second end comprises a second width value, the second width value greater than the first width value. The side posts of the plurality of side posts positioned within the second width of the autorack railcar have a width that is less than a width of the side posts positioned within the first width of the autorack railcar.

In particular embodiments, the first width value is approximately 9 feet 11 inches. The second width value may be between 9 feet 11 inches and approximately 10 feet 8 inches.

In particular embodiments, a distance between a centerline of the autorack railcar and a side post positioned within the second width of the autorack railcar is between 4 feet 6 inches and 5 feet 2 inches. A distance between a centerline of the autorack railcar and a side post positioned closest to the first end of the autorack railcar may be between 4 feet and 4 feet 8 inches. The side post positioned closest to the first end of the autorack railcar may comprise a width that is generally constant along a vertical dimension of the autorack railcar.

In particular embodiments, the first end of the autorack railcar comprises an end enclosure operable to rotate between a closed position and an open position. An opening in the end enclosure in the open position is between 8 feet 7 inches and 9 feet 3 inches.

In particular embodiments, a third width of the autorack railcar between the first longitudinal side and the second longitudinal side proximate either the first end or the second end comprises a third width value. The third width value is greater than or equal to the first width value and less than or equal to the second width value. The third width value may be approximately 10 feet and 3 inches.

In particular embodiments, the first longitudinal side comprises a center panel and an intermediate panel. The center panel is disposed between a center of the railcar and the intermediate panel and the intermediate panel is disposed between the center panel and the first end or the second end. A width of the autorack railcar at the intermediate panel is greater than a width of the autorack railcar at the center panel. The side posts of the plurality of side posts positioned along the intermediate panel have a width that is less than a width of the side posts positioned along the center panel.

In particular embodiments, the width of the intermediate panel increases in width as the intermediate panel extends from an edge adjacent to the center panel towards the first or second end. The side posts along the intermediate panel decrease in width as the intermediate panel extends from an edge adjacent to the center panel towards the first or second end.

According to some embodiments, a railcar comprises a first end and a second end, and a first longitudinal side and a second longitudinal side disposed between the first end and the second end. Each of the first longitudinal side the second longitudinal side comprise a plurality of side posts. A width between the first longitudinal side and the second longitudinal side is narrowest at the center of the railcar and increases in width as the first longitudinal side and the second longitudinal side extend towards the first or second end of the railcar. A width of a side post of the plurality of side posts side is greatest for a side post positioned near the center of the railcar and a width of the side posts decreases as the side posts extend towards the first or second end of the railcar.

In particular embodiments, a distance between a centerline of the railcar and a side post is between 4 feet 6 inches and 5 feet 2 inches. A distance between a centerline of the railcar and a side post positioned closest to the first end of the railcar may be between 4 feet and 4 feet 8 inches. The side post positioned closest to the first end of the railcar may comprise a width that is generally constant along a vertical dimension of the railcar.

In particular embodiments, the first end of the railcar comprises an end enclosure operable to rotate between a closed position and an open position, and wherein an opening in the end enclosure in the open position is between 8 feet 7 inches and 9 feet 3 inches.

In particular embodiments, the width between the first longitudinal side and the second longitudinal side is between 9 feet 11 inches and approximately 10 feet 8 inches.

As a result, particular embodiments of the present disclosure may provide numerous technical advantages. For example, the additional autorack railcar width provides additional room within the railcar, which improves crew ergonomics by providing more room to conduct normal operations and reduces the likelihood of vehicle damage caused by close working conditions. Larger enclosure openings at the ends of the autorack railcar facilitate loading and transport of wider vehicles. Some embodiments facilitate use of historical fixed-width autorack roof panels and provide convertibility of a legacy fleet to the hourglass shape and a recertification processes with minimal to no modifications made to the roof profiles. The backwards compatibility provides inventory flexibility. Particular embodiments of the present disclosure may provide some, none, all, or additional technical advantages.

BRIEF DESCRIPTION OF THE DRAWINGS

A more complete and thorough understanding of the particular embodiments and advantages thereof may be acquired by referring to the following description taken in conjunction with the accompanying drawings, in which like reference numbers indicate like features, and wherein.

DETAILED DESCRIPTION

Figure 1:
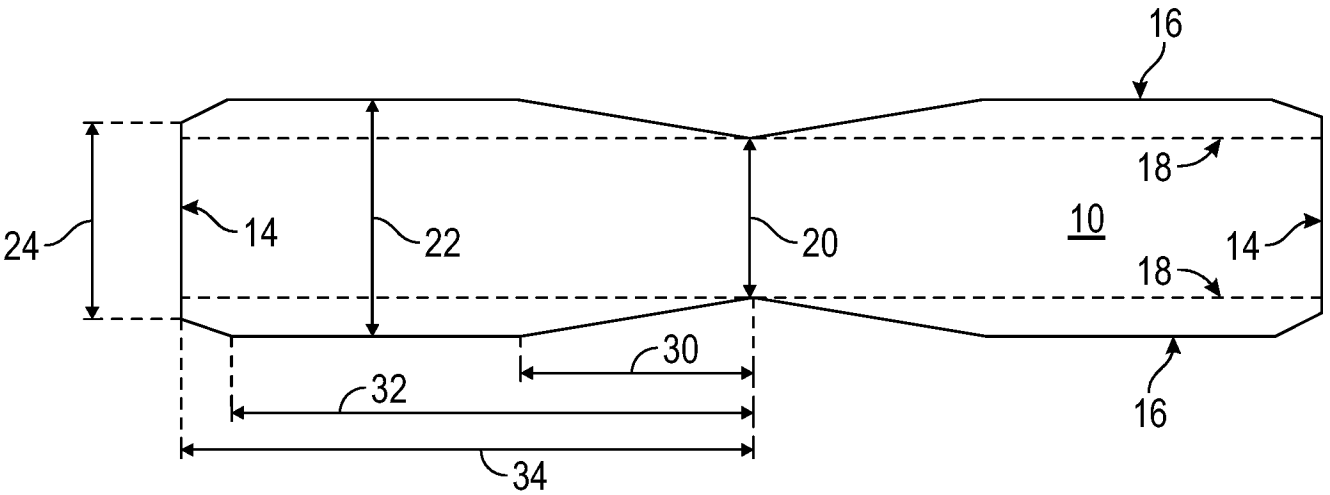
FIG. 1 is a schematic diagram overhead view of an autorack railcar, according to some embodiments.

According to some embodiments, an autorack railcar comprises a flat deck railcar with an overlying structure built upon it. The flat deck may be a flush deck, where the deck is a consistent height above the top of rail its entire length or may be of a low level raised sill variety. This latter type may have various heights of the deck with the lowest level being in the center of the railcar, the ends of the railcar being at standard heights to be compatible with other autorack railcars for loading vehicles, and transition areas between these two heights. The low level raised sill flatcar provides additional vertical clearance for vehicles loaded onto the autorack.

Another embodiment of an autorack consists of a unibody-style design. There is no underlying flatcar but rather the entire railcar structure is integrated together. There are certain advantages and disadvantages for this design, but all of these autorack types are used in today's industry.

For all of these types, the overlying structure is generally the same. There are vertical posts or structural sections located at specified locations on each side along the length of the railcar. This provides support for the roof and interior decks as well as the side screens that enclose the interior portion. Part of this side structure consists of shear elements that transfer horizontal, longitudinal and lateral forces from railcar operations into the underlying railcar structure. The side structure also supports the end enclosures or doors used to enclose the interior.

Within the sides, the interior of the autorack may use the deck of the flatcar or bottom structure to support vehicles for transport. Depending upon the height of vehicles to be transported, one or two additional decks may be used between the bottom of the autorack and the roof to transport additional vehicles. Each deck provides means to restrain the vehicles from moving during transport.

As one experienced in the design and use of autoracks understands, the interior width is important not only for providing enough space to allow vehicles to be driven into the autorack, it must provide space for drivers to open vehicle doors to exit the vehicles as well as space to permit personnel to apply the vehicle tie downs for transport. The limiting factors for interior width may include the end enclosure or door openings, the width between the side posts or vertical support structures, and/or the side sills of an underlying flatcar. The widest vehicle that can be transported is limited by the lesser of these widths so maximizing any of these widths allows the autorack to transport a larger percentage of vehicles available and may reduce damage to vehicles by providing more width for personnel for door opening clearance and tie down operations.

Conventional fixed-width autorack railcars provide limited interior space for personnel to maneuver between the side panels of the railcar and the vehicles loaded in the railcar. Particular embodiments obviate the problems described above and include a variable width, hourglass-shaped autorack railcar.

AAR Plate K permits modification of maximum railcar width under particular conditions, such as truck center distance, car height, etc. The maximum width at any longitudinal location along a railcar may be determined by a formula. Particular embodiments include a variable width railcar that complies with regulations while also providing additional width and interior clearance (e.g., up to 4.5" per side) for much of the length of the railcar. The additional interior clearance improves crew ergonomics by providing more room to conduct normal operations and reduces the likelihood of vehicle damage caused by close working conditions.

As an example, AAR Plate J restricts railcar width to a 10' 8" maximum at any location for a railcar with truck centers spaced at 55' 1" apart. The maximum width at the center of a railcar with a common truck spacing of, for example, 66' is approximately 9' 11". Moving longitudinally outward from the center of the railcar, the maximum width increases to 10' 8". Using a 90' railcar as an example, the permissible width approximately 18' from the center of the car outward to approximately 43' is 10' 8". From 43' outward to the end of the railcar (i.e., 45'), the permissible width is approximately 10' 3.8".

Particular embodiments take advantage of the variable width requirements to expand the width of an autorack railcar at particular locations beneficial for the crew that loads or unloads the autorack railcar. For example, although the maximum width at the center of an autorack railcar with a common truck spacing of 66' is approximately 9' 11", the width of the autorack railcar may be wider in other locations. Particular embodiments include an hourglass-shaped autorack railcar where the autorack railcar is narrow at a center point and gets wider towards each end of the car. Particular embodiments provide extra width at the locations where an operator entering or exiting a vehicle during the loading/unloading process may benefit from extra maneuverability.

Plate K specifies requirements for taller railcars. Particular embodiments may include hourglass-shaped autorack railcars for any suitable configuration or combination of truck center distances, railcar lengths, railcar heights, or other suitable parameters.

Particular embodiments and their advantages are best understood by reference to FIGS. 1-11 wherein like reference numbers indicate like features.

FIG. 1 is a schematic diagram overhead view of an autorack railcar, according to some embodiments. Autorack railcar 10 includes ends 14 and longitudinal sides 16. Longitudinal sides 16 and ends 14 enclose a rack for transporting vehicles and generally protect the vehicles from the elements during transport.

Autorack railcar 10 includes variable widths along the longitudinal length (i.e., variable width between longitudinal sides 16) of the railcar. Dashed lines 18 represent the fixed width of a conventional autorack railcar.

In particular embodiments, the width of autorack railcar 10 approximates an hourglass shape with a minimum width 20 at the center of autorack railcar 10 and a width that expands over the distance 30 to a maximum width 22. The maximum width 22 continues out to distance 32 and then reduces to end width 24 at distance 34. As illustrated, particular embodiments provide additional width than a conventional autorack railcar (represented by dashed lines 18) at particular locations along the length of railcar 10. The additional width may provide additional room for crew members to operate and may reduce the chances of vehicle damage.

As a particular example, autorack railcar 10 may comprise a 90' railcar with trucks spaced at 66'. In this example, minimum width 20 is approximately 9' 11". The width of autorack railcar 10 may gradually increase over distance 30 (e.g., approximately 18' from center) to maximum width 22. In this example, maximum width 22 is approximately 10' 8". The width of autorack railcar 10 may be a constant 10' 8" between distance 30 (e.g., approximately 18' from center) and distance 32 (e.g., approximately 43' from center). At the end of autorack railcar 10, its width may gradually reduce between distance 32 (e.g., approximately 43' from center) and 34 (e.g., approximately 45' from center) to end width 24. In this example, end width 24 is approximately 10' 3.8".

Accordingly, some portions of the example autorack railcar 10 (e.g., the portion having width 22) may be up to approximately 9" wider than a conventional fixed width autorack railcar (i.e., 10' 8"-9' 11"=9"). The additional 9" may provide extra clearance (e.g., up to 4.5") on each side of a vehicle loaded in autorack railcar 10, which provides additional room for a crew to perform interior operations in autorack railcar 10. Other embodiments may include any suitable dimensions.

Figure 2:
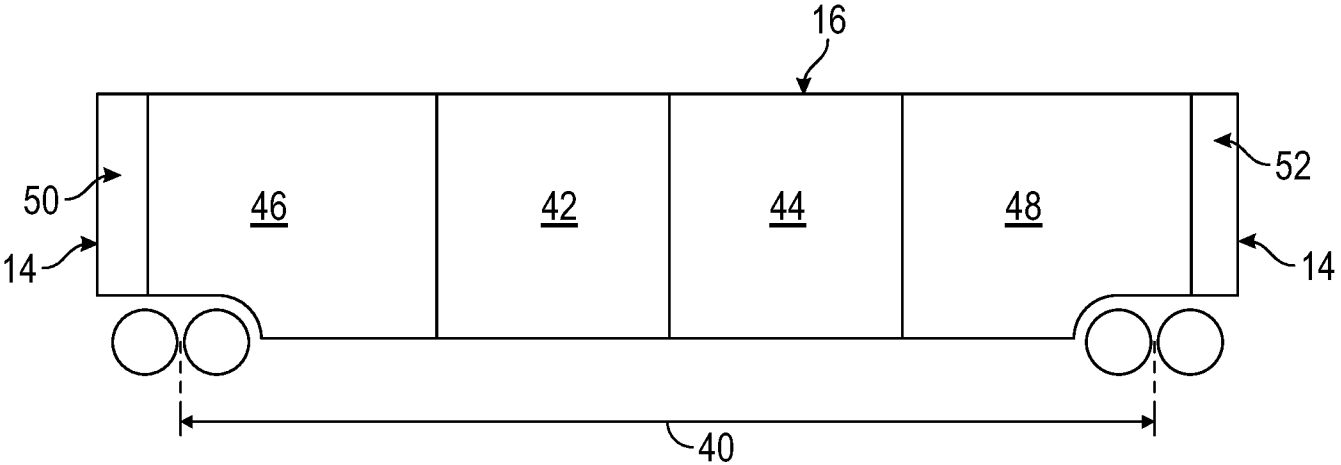
FIG. 2 is a schematic diagram side view of an autorack railcar, according to some embodiments.

FIG. 2 is a schematic diagram side view of an autorack railcar, according to some embodiments. FIG. 2 illustrates a side view, for example, of autorack railcar 10 described with respect to FIG. 1. Autorack railcar 10 includes truck center distance 40. The side panels of autorack railcar 10 include left center panel 42, right center panel 44, left intermediate panel 46, right intermediate panel 48, left end panel 50, and right end panel 52.

Left center panel 42 and right center panel 44 are positioned on each side of the center line of autorack railcar 10. Railcar 10 has a minimum width at the center of left center panel 42 and right center panel 44. Moving outward longitudinally from the center of autorack railcar 10, autorack railcar 10 has a maximum width along the length of left intermediate side panel 46 and right intermediate side panel 48. The width of autorack railcar 10 reduces again along left end panel 50 and right end panel 52. Although the various panels 42, 44, 46, 48, 50 and 52 are described as a single panel, in particular embodiments each panel may comprise any number of panels or sub-panels.

As a particular example, autorack railcar 10 may comprise a 90' railcar and truck center distance 40 may be approximately 66'. The width of autorack railcar 10 at left center panel 42 may be approximately 9' 11" at the center of the railcar. Left center panel 42 may be approximately 18' in length and the width of autorack railcar 10 may be approximately 10' 8" at the leftmost side of center panel 42. Right center panel 44 may be approximately 18' in length and the width of autorack railcar 10 may be approximately 10' 8" at the rightmost side of right center panel 44.

The width of autorack railcar 10 for the length of left intermediate side panel 46 and right intermediate side panel 48 may be approximately 10' 8". Left intermediate side panel 46 and right intermediate side panel 48 may be approximately 25' in length.

Left end panel 50 and right end panel 52 may be approximately 2' in length. The width of autorack railcar 10 is approximately 10' 8" at the rightmost side of left end panel 50 and approximately 10' 3.8" at the leftmost side of left end panel 50. The width of autorack railcar 10 is approximately 10' 8" at the leftmost side of right end panel 52 and approximately 10' 3.8" at the rightmost side of right end panel 52.

In particular embodiments, the width of autorack railcar 10 is generally constant over a vertical dimension of autorack railcar 10. For example, the width of autorack railcar 10 at any particular location along longitudinal sides 16 is the same width from the bottom of longitudinal side 16 (e.g., near the railcar floor) to the top of longitudinal side 16 (e.g., near the railcar roof). As a particular example, the width of autorack railcar 10 at left intermediate side panel 46 may be 10' 8". The width of autorack railcar 10 at left intermediate side panel 46 is generally a constant 10' 8" across the vertical dimension of left intermediate side panel 46 (e.g., generally constant from floor to roof).

Other embodiments may include any suitable dimensions or any suitable number of side panels. For example, particular embodiments may not include left end panel 50 or right end panel 52. In such embodiments, left intermediate side panel 46 and/or right intermediate side panel 48 may extend to the end of autorack railcar 10, and the width of autorack railcar 10 may be constant (e.g., approximately 10' 3.8" in some embodiments) along the length of left intermediate side panel 46 and/or right intermediate side panel 48.

The example autorack railcar illustrated in FIGS. 1 and 2 includes generally straight side panels that may be connected at various angles to transition between the various widths at the various locations along the length of the railcar.

For example, left end panel 50, left intermediate side panel 46, and left center panel 42 may all comprise panels that are straight along their horizontal dimension. Left end panel 50 is coupled to left intermediate side panel 46 at a first angle, and left intermediate side panel 46 is coupled to left center panel 42 at a second angle to vary the width along the longitudinal direction of autorack railcar 10. In particular embodiments, generally straight side panels may be relatively easy and inexpensive to manufacture compared to other configurations. Other embodiments may include other types of side panels, such as curved side panels, or a combination of straight and curved side panels.

Figure 3:
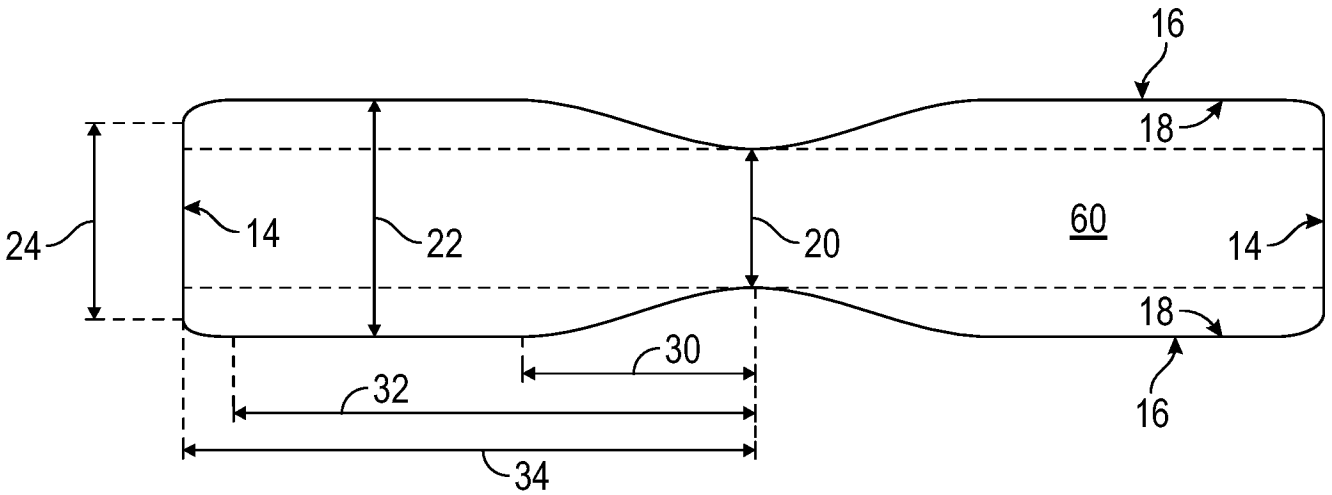
FIG. 3 is a schematic diagram overhead view of another autorack railcar, according to some embodiments.

FIG. 3 is a schematic diagram overhead view of another autorack railcar, according to some embodiments. Autorack railcar 60 is similar to autorack railcar 10 illustrated in FIG. 1, except autorack railcar 60 includes curved side panels.

For example, each longitudinal side 16 may include curved side panels that curve between the centerline and distance 30 on either side of the center line. In particular embodiments, the curved side panel may comprise a single curved side panel or a combination of several curved sub-panels. In particular embodiments, the curved side panels may be curved for the vertical length of the panel (e.g., the side panel may be curved from floor to roof).

As another example, each longitudinal side 16 may include curved side panels near each end 14 of autorack railcar 60, such as between distances 32 and 34. Although each curve is illustrated with a particular radius, other embodiments may include any suitable radius to maximize the interior space of an autorack railcar without exceeding width regulations at any particular point along the length of the railcar.

Figure 4:
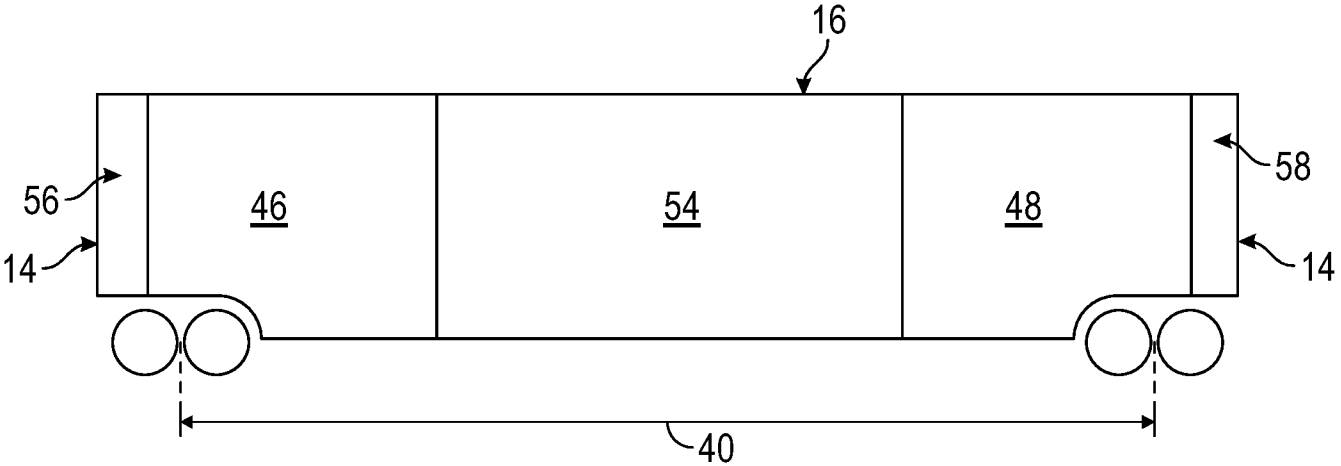
FIG. 4 is a schematic diagram side view of another autorack railcar, according to some embodiments.

FIG. 4 is a schematic diagram side view of another autorack railcar, according to some embodiments. FIG. 4 illustrates a side view, for example, of autorack railcar 60 described with respect to FIG. 3. Longitudinal side 16 of the autorack railcar includes curved side panels 54, 56, and 58.

In particular embodiments, the racks for transporting vehicles within an autorack railcar may be positioned or configured with the respect to the autorack railcar width dimensions to optimize crew access to the vehicles for transport. For example, the rack may be configured such that the hood or trunk portion of the vehicle is located in the narrower width portion of the autorack railcar, and vehicle openings, such as the driver side window and door, are located in the wider portion of the autorack railcar.

Figure 5:
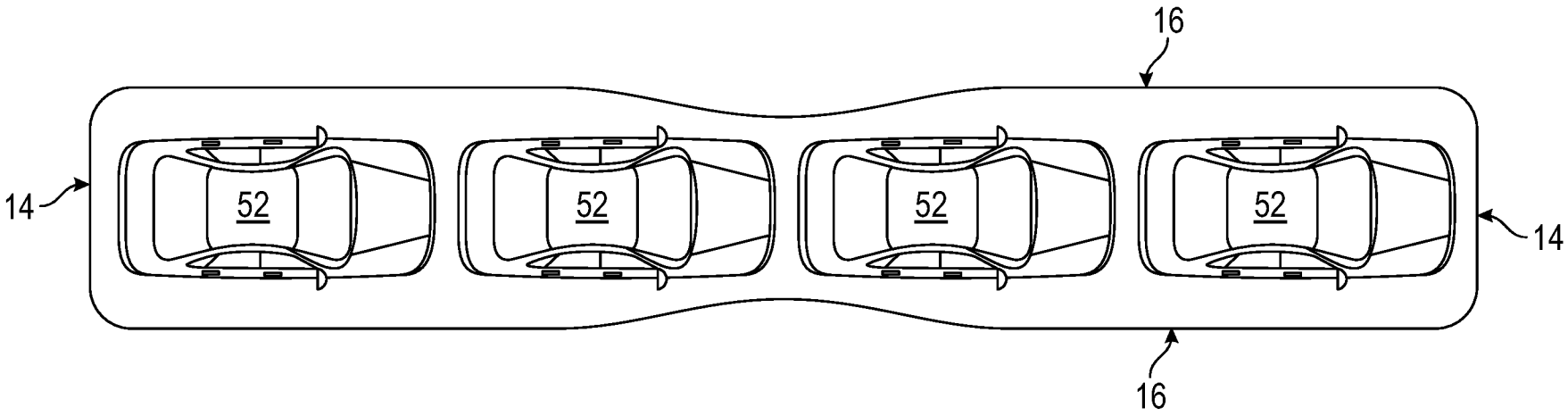
FIG. 5 is a schematic diagram overhead view of an example autorack loaded with vehicles, according to a particular embodiment.

FIG. 5 is a schematic diagram overhead view of an example autorack loaded with vehicles, according to a particular embodiment. The example autorack railcar, such as autorack railcar 10 described with respect to FIGS. 1 and 2 or autorack railcar 60 described with respect to FIGS. 3 and 4, includes vehicles 52. Although 4 vehicles are illustrated, particular embodiments may include any suitable number of vehicles on one or more decks.

As illustrated, the varying width of longitudinal sides 16 provides extra room for maneuvering around vehicles 52. The extra room is particularly advantageous when vehicles 52 comprise wide vehicles, such as pickup trucks with sets of dual rear wheels, or when vehicles 52 comprise vehicles without folding mirrors.

As described above, an hourglass-shaped autorack provides additional interior width to provide more side clearance to vehicles loaded into the rack and facilitates loading of wider vehicles. Particular embodiments also include changes to a traditional roof assembly to connect the roof with the hourglass-shaped rack structure.

A roof assembly consists of roof panels and roof rails that attach the roof panels to the rack structure. The hourglass-shaped rack structure changes width along its length, but standard existing roof panels are of a constant width.

Autoracks today use a standard corrugated roof panel. The corrugations provide the necessary structural properties to the roof to withstand the autorack forces applied to it, including snow and ice loads, rack deflections and side loads, etc. The standard roof panel was designed for a constant width autorack and is not compatible with an hourglass-shaped section below it that it needs to attach to.

Although the hourglass autorack design increases the width between the side walls of the rack, the roof area is also important because it extends downward below the roof line of the vehicles under transport. Clearance to the roof becomes particularly important because a driver needs to open the door of the vehicle to exit and enter the vehicle inside the rack. As the vehicle door is opened, the top corner of the door may be the closest point to making contact with the interior of the rack in the roof area. Contact could cause vehicle damage and should be avoided.

Some embodiments include a roof assembly with hourglass-shaped roof panels expanded and reshaped to meet the extents of the AAR clearance plate (i.e., the roof panels conform to the same hourglass-shape as the underlying railcar). One benefit is a roof profile that extends to the limits of the AAR plate clearance that provides more interior space in the proximate area between sidewall posts numbers 1 and 5 and between sidewall posts number 8 and 12 in the vertical area of the roof.

Because the hourglass-shaped rack may not change width near center of the railcar, existing standard roof panels may be used near the center of the railcar. Where the hourglass-shaped rack achieves its maximum width, existing wider roof panels may be used there. One or more tapered roof panels may be used to transition between the panels near the center of the rack and the wider panels toward the end of the rack. An example is illustrated in FIG. 6.

Figure 6:
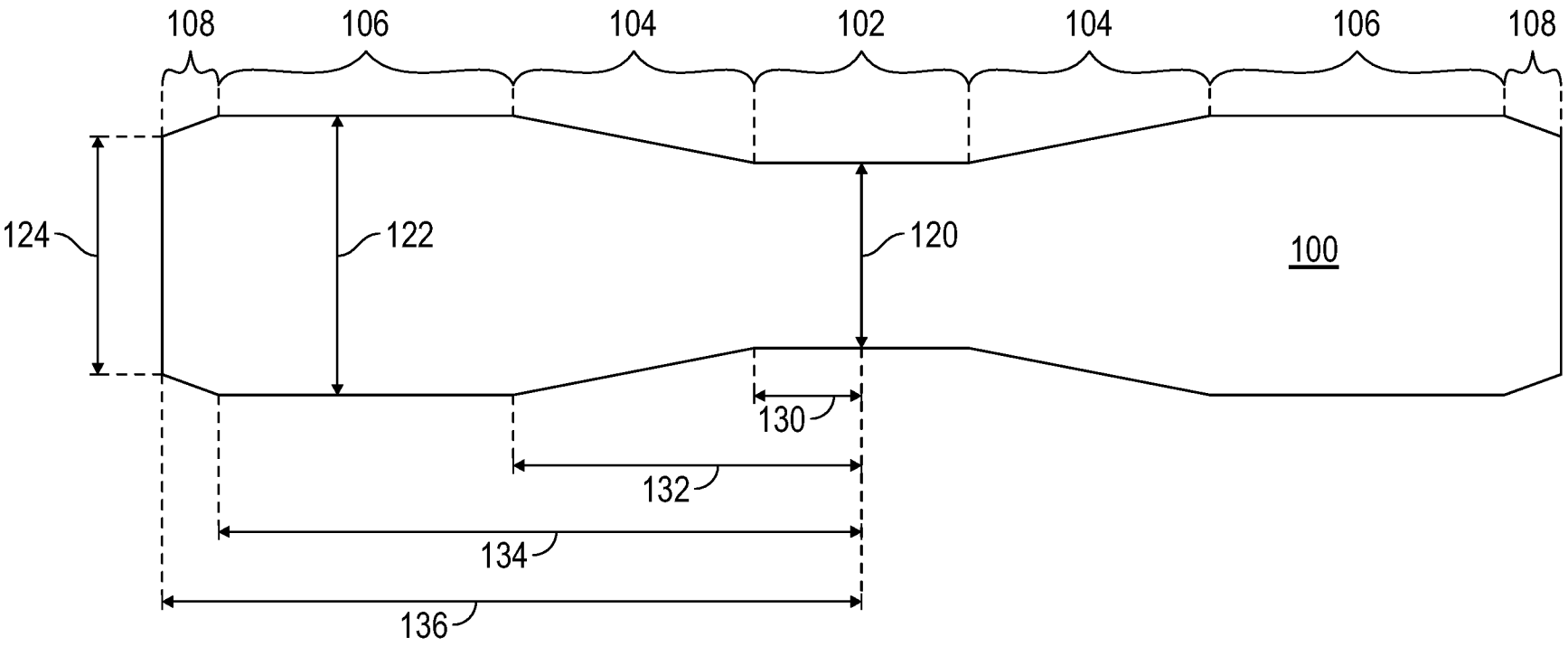
FIG. 6 is an overhead plan view of an hourglass-shaped autorack railcar roof assembly, according to a particular embodiment.

FIG. 6 is an overhead plan view of an hourglass-shaped autorack railcar roof assembly, according to a particular embodiment. Autorack railcar roof assembly 100 includes center roof panel 102, first intermediate roof panels 104, second intermediate roof panels 106 and end roof panels 108.

In the illustrated example, center roof panel 102 is a constant width. First intermediate roof panels 104 increase in width as the first intermediate roof panel extends from an edge adjacent to center roof panel 102 towards an opposite edge. Second intermediate panels 106 are a constant width. End roof panels 108 decrease in width as the end roof panel extends from an edge adjacent to second intermediate roof panel 106 towards an opposite edge. The widths of center roof panel 102, first intermediate roof panels 104, second intermediate roof panels 106, and end roof panels 108 correspond to the widths of the side walls of an underlying autorack railcar (such as the autorack railcars illustrated in FIGS. 1 and 3).

In particular embodiments, the width of autorack railcar roof assembly 100 approximates an hourglass shape with a minimum width 120 at the center of autorack railcar roof assembly 100 and a width that expands over the distance 132 to a maximum width 122. The maximum width 122 continues out to distance 134 and then reduces to end width 124 at distance 136. The additional width may provide additional room for crew members to operate and may reduce the chances of vehicle damage.

As a particular example, autorack railcar roof assembly 100 may comprise a roof assembly for a 90' railcar with trucks spaced at 66'. In this example, minimum width 120 is approximately 9' 11". The width of autorack railcar roof assembly 100 may gradually increase over distance 132 to maximum width 122. In this example, maximum width 122 is approximately 10' 8". The width of autorack railcar roof assembly 100 may be a constant 10' 8" between distance 132 and distance 134. At the end of autorack railcar roof assembly 100, its width may gradually reduce between distance 134 and 136 (e.g., approximately 45' from center) to end width 124. In this example, end width 124 is approximately 10' 3.8".

Accordingly, some portions of the example autorack railcar roof assembly 100 (e.g., the portion having width 122) may be up to approximately 9" wider than a conventional fixed width autorack railcar (i.e., 10' 8"-9' 11"=9"). The additional 9" may provide extra clearance (e.g., up to 4.5") on each side of a vehicle loaded in the autorack railcar, which provides additional room for a crew to perform interior operations in the autorack railcar. Other embodiments may include any suitable dimensions.

In the examples described above, the exterior width of the railcar is extended in particular locations to increase interior width. In other embodiments, interior dimensions may be increased with little or no increase in exterior dimensions.

The interior width of an autorack refers to the distance between the inside faces of the side posts or other structure, such as the width between the end enclosures (e.g., doors) in the open position. The interior width is usually limited by the size of the side posts or size and location of other structure, such as the structure's longitudinal shear plates, braces, deck attachments, etc.

Some embodiments increase the width of the interior by reducing the dimensions of the side posts in the lateral direction (i.e., the width of the side post). This may enable the posts to be moved further outboard without increasing the exterior width of the autorack, or it may facilitate the exterior of the autorack to be made slightly wider but stay within the width parameters of the governing standards for autoracks.

In some embodiment, the interior width may be increased by revising the width of the autorack structure that transmits the longitudinal shear forces from autorack operation into the underlying railcar structure. The underlying railcar may consist of a flat car railcar or may be a structure that is integrated with the overlying rack that incorporates other railcar components, such as trucks, draft gear and couplers, brakes, etc.

In some embodiments, the doors and their supporting structure and mechanisms may be revised to permit a wider interior clearance for vehicles to pass through during loading and unloading.

Figure 7:
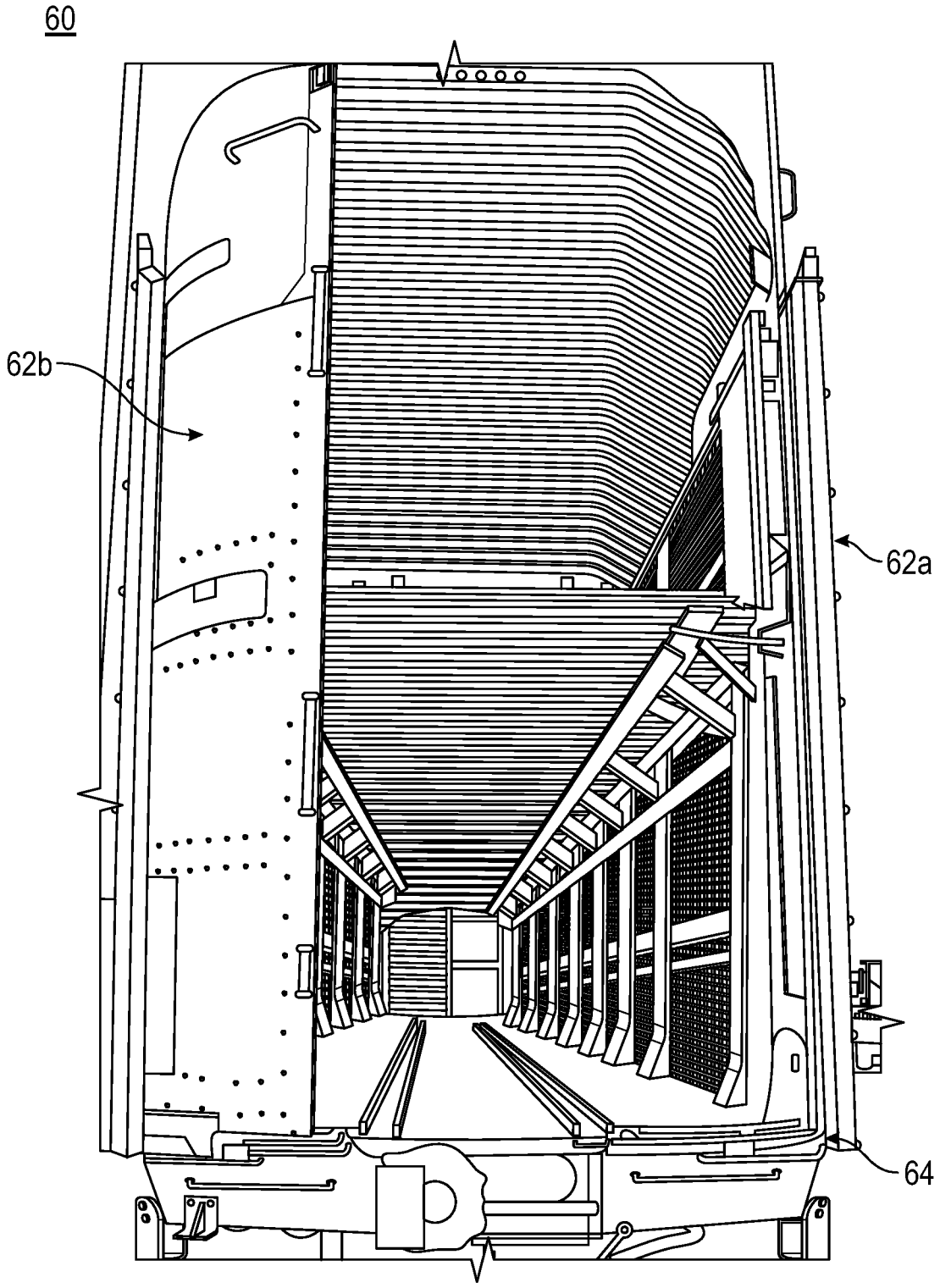
FIG. 7 is a perspective view of an autorack entrance.

FIG. 7 is a perspective view of an autorack entrance. Autorack railcar 60 includes entrance enclosures 62 (also referred to as an end enclosure). Entrance enclosure 62*a* is in an open position and entrance enclosure 62*b* is in a partially open position.

The railcar entrance width depends on the railcar width, the entrance enclosure type (e.g., how wide the enclosure opens), and the support structure for the side walls and/or entrance enclosure. The support structure may include side posts, such as side post 64. In some embodiments, the side post nearest the entrance enclosure may vary in width along its vertical dimension. For example, in the illustrated autorack railcar side post 64 is wider at a bottom portion where side post 64 attaches to the autorack floor. An example is illustrated in FIG. 8.

Figure 8:
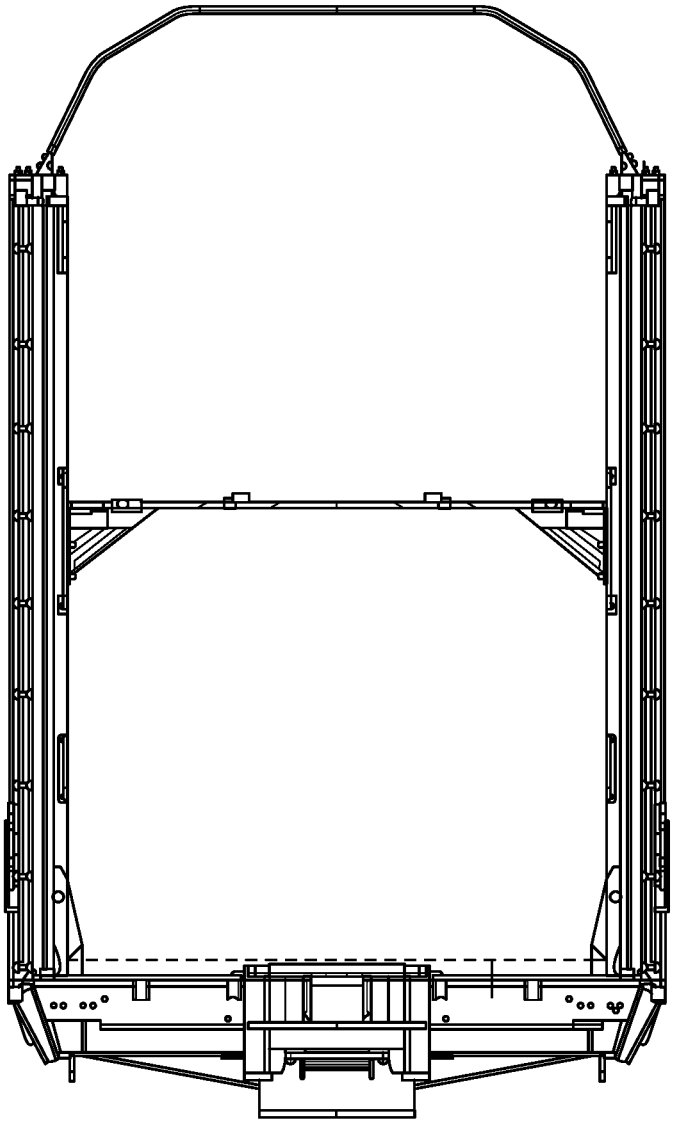
FIG. 8 is a cross sectional end view to an autorack entrance.

FIG. 8 is a cross sectional end view to an autorack entrance. An example side post, such as side post 64, is illustrated in Detail A.

Figure 9:
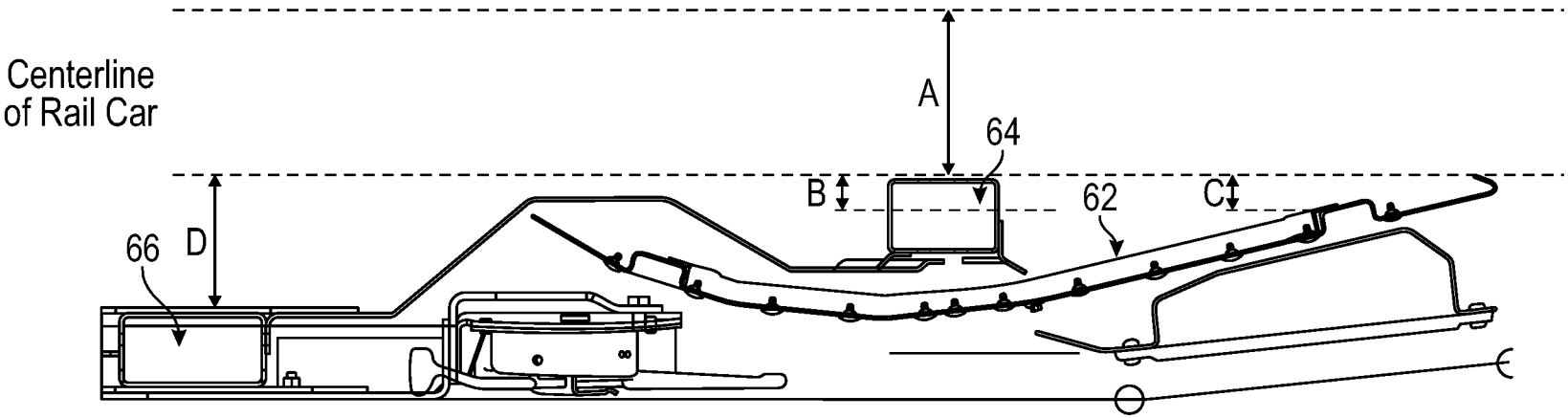
FIG. 9 is an overhead cross sectional view of an autorack entrance.

FIG. 9 is an overhead cross sectional view of an autorack entrance. As illustrated, the width of the autorack entrance may be dictated by the placement and size of side post 64. As illustrated, the distance A between the centerline of the autorack railcar and the number 1 side post (i.e., the side post closes to the end of the railcar illustrated as side post 64) is approximately 4 feet 0.75 inches at the bottom of the side post where the side post is the widest. Higher up on side post 64, the distance A+B between the centerline of the autorack railcar and side post 64 is approximately 4 feet 4 inches. The distance A+D between a centerline of the autorack railcar and the number 2 side post (i.e., side post 66) is approximately 4 feet 6.5 inches.

End enclosure 62 is operable to rotate between a closed position and an open position. In the open position, the distance A+C between the centerline of the autorack railcar and end enclosure 62 is approximately 4 feet 3.75 inches.

Particular embodiments may increase autorack railcar entrance width by minimizing the width of side post 64 and/or side post 66. An example is illustrated in FIGS. 10 and 11.

Figure 10:
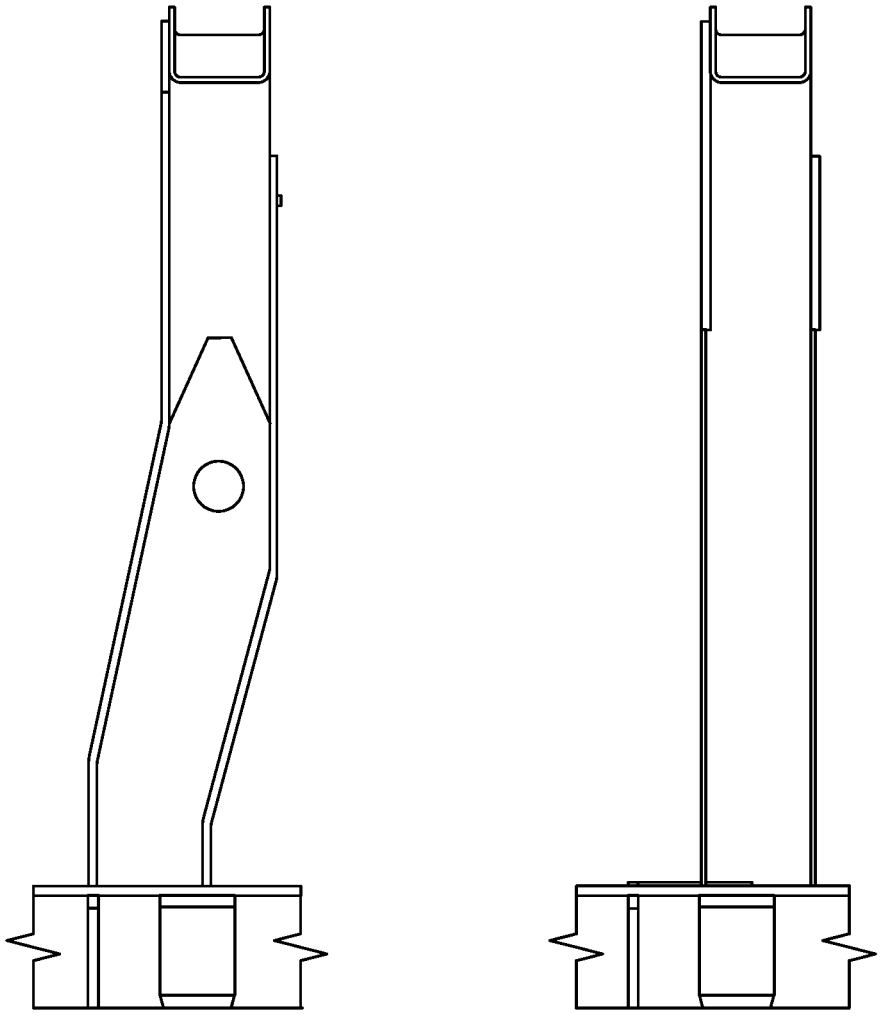
FIG. 10 is a cross sectional view of two side posts.

FIG. 10 is a cross sectional view of two side posts. On the left is a close up view of the side post illustrated in FIG. 8, such as side post 64. On the right is a close up view of a side post according to particular embodiments, such as side post 74 described with respect to FIG. 11. As illustrated, the side post on the right comprises a width that is generally constant along a vertical dimension of the autorack railcar.

Figure 11:
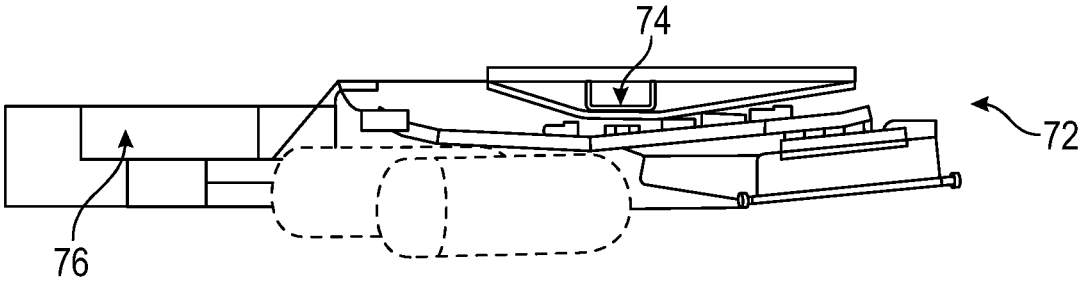
FIG. 11 is an overhead cross sectional view of an autorack entrance, according to a particular embodiment.

FIG. 11 is an overhead cross sectional view of an autorack entrance, according to a particular embodiment. The illustrated autorack railcar includes entrance enclosure 72, first side post 74, and second side post 76.

Instead of first side post 74 extending transversely into the autorack railcar at bottom portion where the side post attaches to the autorack floor (such as side post 64), first side post 74 may comprise a fixed width along its vertical dimension. First side post 74 may be narrower than side post 64. If first side post 74 includes bracing at bottom portion where the side post attaches to the autorack floor, the bracing may extend in a longitudinal direction so that the bracing does not interfere with the entrance width. Reducing the width of first side post 74 and/or moving first side post 74 further outboard increases the entrance width. In some embodiments, the distance between the centerline of the railcar and first side post 74 is increased between 3 and 7 inches compared to a conventional autorack railcar.

In some embodiments, the reduced width of side post 74 may mean that the second side post then dictates the entrance width. In some embodiments, second side post 76 may have reduced width and/or move further outboard to increase the entrance width. In some embodiments, the distance between the centerline of the railcar and second side post 76 is increased between 3 and 7 inches compared to a conventional autorack railcar.

Existing autorack structures optimize side post widths to provide as much interior width as possible. Their size is dictated by the forces they are required to transmit from the roof and decks into the underlying railcar structure. Some of these forces are lateral and result in lateral deflections of the overall structure.

Lateral deflections are a function of the overall rack structure dimensions. For example, for a given side post geometry and resultant side stiffness of the post, the overall structure deflection is determined by the distance between the side posts on either side of the railcar. The closer the side posts are together, the more deflection and stress will occur.

With the hourglass shape of the autorack, the side posts on either side may be further apart which reduces the lateral deflection and resulting stress in the side posts. This facilitates narrower side posts that increase the interior width without increasing the overall structural deflection or increasing stresses beyond their limit.

Increasing the width of the autorack interior between side posts enables transport of wider vehicles, providing they can pass through the end enclosure opening. Thus, particular embodiments include an improved door system that increases the entrance width.

In particular embodiments, the door system takes advantage of the changes to the number 1 and/or 2 side posts. The doors may open further or use a modified trajectory to increase the opened width. Thus, the door structure may provide more vehicle clearance when loading.

For example, in some embodiments the distance between the centerline of the railcar and end enclosure 72 is increased between 3 and 7 inches compared to a conventional autorack railcar.

In general, particular embodiments increase distances B, C and D illustrated in FIG. 9 between 3 and 7 inches compared to a conventional autorack railcar.

Each of the above embodiments may be incorporated separately or used in any combination to increase the interior width of the autorack.

In particular embodiments, an autorack railcar may be constructed by adding a rack for transporting vehicles to a flatcar. Particular embodiments may include adding side panels, end panels or end doors, and a roof. Conventional flatcars generally have a constant width. In particular embodiments, a flatcar may be constructed with a varying width, such as any of the varying widths described in the embodiments above, for further constructing a variable width autorack railcar.

Although the example embodiments illustrated are symmetrical around a centerline of the autorack railcar, other embodiments may not be symmetrical. Particular embodiments may include articulated autorack railcars or sets of articulated autorack railcars.

Some embodiments of the disclosure may provide one or more technical advantages. As an example, some embodiments provide interior clearance that improves crew ergonomics by providing more room to conduct normal operations and reduces the likelihood of vehicle damage caused by close working conditions.

Modifications, additions, or omissions may be made to the systems and apparatuses disclosed herein without departing from the scope of the invention. The components of the systems and apparatuses may be integrated or separated. Moreover, the operations of the systems and apparatuses may be performed by more, fewer, or other components.

Modifications, additions, or omissions may be made to the methods disclosed herein without departing from the scope of the invention. The methods may include more, fewer, or other steps. Additionally, steps may be performed in any suitable order.

Although embodiments of the present disclosure and their advantages have been described in detail, it should be understood that various changes, substitutions and alterations can be made herein without departing from the spirit and scope of the invention as defined by the claims below.

The invention claimed is:

1. An autorack railcar comprising:

a first end and a second end;

a first longitudinal side and a second longitudinal side disposed between the first end and the second end, each of the first longitudinal side the second longitudinal side comprising a plurality of side posts;

a rack for transporting vehicles generally enclosed by the first end, the second end, the first longitudinal aide, and the second longitudinal side; wherein:

a first width of the autorack railcar between the first longitudinal side and the second longitudinal side proximate a center of the autorack railcar comprises a first width value;

a second width of the autorack railcar between the first longitudinal side and the second longitudinal side between the center of the autorack railcar and either the first end or the second end comprises a second width value, the second width value greater than the first width value; and the side posts of the plurality of side posts positioned within the second width of the autorack railcar have a width that is less than a width of the side posts positioned within the first width of the autorack railcar, wherein a width of a side post refers to a distance the side post extends into an interior of the autorack railcar.

2. The autorack railcar of claim 1, wherein the first width value is approximately 9 feet 11 inches.

3. The autorack railcar of claim 1, wherein the second width value is between 9 feet 11 inches and approximately 10 feet 8 inches.

4. The autorack railcar of claim 1, wherein a distance between a centerline of the autorack railcar and a side post positioned within the second width of the autorack railcar is between 4 feet 6 inches and 5 feet 2 inches.

5. The autorack railcar of claim 1, wherein a distance between a centerline of the autorack railcar and a side post positioned closest to the first end of the autorack railcar is between 4 feet and 4 feet 8 inches.

6. The autorack railcar of claim 1, wherein a side post positioned closest to the first end of the autorack railcar comprises a width that is generally constant along a vertical dimension of the autorack railcar.

7. The autorack railcar of claim 1, wherein the first end of the autorack railcar comprises an end enclosure operable to rotate between a closed position and an open position, and wherein an opening in the end enclosure in the open position is between 8 feet 7 inches and 9 feet 3 inches.

8. The autorack railcar of claim 1, wherein a third width of the autorack railcar between the first longitudinal side and the second longitudinal side proximate either the first end or the second end comprises a third width value, the third width value greater than or equal to the first width value and less than or equal to the second width value.

9. The autorack railcar of claim 8, wherein the third width value is approximately 10 feet and 3 inches.

10. The autorack railcar of claim 1, the first longitudinal side comprises a center panel and an intermediate panel, the center panel disposed between a center of the railcar and the intermediate panel and the intermediate panel disposed between the center panel and the first end or the second end; and a width of the autorack railcar at the intermediate panel is greater than a width of the autorack railcar at the center panel.

11. The autorack railcar of claim 10, wherein the side posts of the plurality of side posts positioned along the intermediate panel have a width that is less than a width of the side posts positioned along the center panel.

12. An railcar comprising:

a first end and a second end;

a first longitudinal side and a second longitudinal side disposed between the first end and the second end, each of the first longitudinal side and the second longitudinal side comprising a plurality of side posts; wherein a width between the first longitudinal side and the second longitudinal side is narrowest at the center of the railcar and increases in width as the first longitudinal side and the second longitudinal side extend towards the first or second end of the railcar; and a width of a side post of the plurality of side posts comprising a longitudinal side is greatest for a side post positioned near the center of the railcar and a width of the side posts decreases as the side posts populate towards the first or second end of the railcar, wherein a width of a side post refers to a distance the side post extends into an interior of the autorack railcar.

13. The railcar of claim 12, wherein a distance between a centerline of the railcar and a side post is between 4 feet 6 inches and 5 feet 2 inches.

14. The railcar of claim 12, wherein a distance between a centerline of the railcar and a side post positioned closest to the first end of the railcar is between 4 feet and 4 feet 8 inches.

15. The railcar of claim 12, wherein a side post positioned closest to the first end of the railcar comprises a width that is generally constant along a vertical dimension of the railcar.

16. The railcar of claim 12, wherein the first end of the railcar comprises an end enclosure operable to rotate between a closed position and an open position, and wherein an opening in the end enclosure in the open position is between 8 feet 7 inches and 9 feet 3 inches.

17. The railcar of claim 12, wherein the width between the first longitudinal side and the second longitudinal side is between 9 feet 11 inches and approximately 10 feet 8 inches.

* * * * *